United States Patent [19]

Jennings

[11] 4,300,795

[45] Nov. 17, 1981

[54] SLIDING GLASS WINDOW AND DOOR LOCK APPARATUS INCLUDING LOCK UNIT WITH DUAL SPRING BIASED ECCENTRICS

[76] Inventor: Robert N. Jennings, 4026 Olympic St., San Diego, Calif. 92115

[21] Appl. No.: 74,066

[22] Filed: Sep. 10, 1979

[51] Int. Cl.[3] ..... E05C 17/54

[52] U.S. Cl. ..... 292/257; 292/DIG. 47

[58] Field of Search ..... 292/257, 258, DIG. 46, 292/DIG. 47, DIG. 7, 54

[56] References Cited

U.S. PATENT DOCUMENTS

| | | | |
|---|---|---|---|
| 696,819 | 4/1902 | Hoyt | 292/54 |
| 718,007 | 1/1903 | Linn | 292/54 |
| 840,077 | 1/1907 | Maxwell . | |
| 1,075,444 | 10/1913 | Starkey | 292/54 |
| 1,101,253 | 6/1914 | Champ | 292/54 |
| 2,095,037 | 10/1937 | Reintjes | 292/257 |
| 2,629,466 | 2/1953 | Nardulli | 189/72 |
| 2,665,430 | 1/1954 | Ross et al. | 292/257 UX |
| 3,756,641 | 9/1973 | Dugan | 292/258 |
| 3,975,041 | 8/1976 | Edison | 292/258 |
| 4,062,576 | 12/1977 | Jennings et al. | 292/257 X |
| 4,171,835 | 10/1979 | Conley et al. | 292/DIG. 46 |

FOREIGN PATENT DOCUMENTS

| | | | |
|---|---|---|---|
| 579080 | 6/1933 | Fed. Rep. of Germany | 292/54 |

*Primary Examiner*—Richard E. Moore

*Attorney, Agent, or Firm*—Brown & Martin

[57] ABSTRACT

The apparatus includes a lock unit having dual eccentrics that are spring biased toward an opposing planar support flange. The lock unit is mounted so that a selected sidewall of a conventional sliding panel track is squeezed between the eccentrics and the support flange by the force of the spring. Slide stops extend from the support flange into the operative area of the track to prevent horizontal sliding movement of the panel. The apparatus further includes a lift stop which may be used in conjunction with the lock unit to prevent the sliding panel from being lifted clear of the lower track. It comprises a flat spring having a bias toward assuming a U-shaped configuration. The spring legs are spread so that the spring can be inserted into the upper panel track above the panel.

1 Claim, 10 Drawing Figures

SLIDING GLASS WINDOW AND DOOR LOCK APPARATUS INCLUDING LOCK UNIT WITH DUAL SPRING BIASED ECCENTRICS

BACKGROUND OF THE INVENTION

Sliding glass windows and sliding glass doors have come into widespread use in home construction. Such doors and windows are distinguished from conventional construction in that they slide in horizontal tracks rather than being lifted vertically in vertical tracks or swinging on a vertical hinge axis. Sliding glass windows and doors are generally considered to be more adaptable to different installations than conventional fixtures, to provide a more attractive installation, and to be easier to use and maintain. However, the installational and operational flexibility of such windows and doors also results in an installation that is difficult to securely lock. The locking or latching devices provided as part of such sliding panels typically do not prevent an intruder from lifting the sliding panel into the upper track sufficiently to clear the lower track so that the panel may be lifted completely free of the tracks, or at least sufficiently to permit the intruder to move the panel so that a wire or hook may be inserted between the sliding and fixed panels and utilized to operate the latch.

An increase in the crimes against property including vandalism and burgulary has made it increasingly important to secure sliding panels against unauthorized operation. As a result of widespread acknowledgement of the need, numerous sliding glass door and sliding window supplemental locks have been provided. One such device is in the form of a dead bolt which is permanently mounted on the track and is operated in and out of holes drilled through the window track. Such devices are sufficiently difficult to operate and they frequently fall into disuse. The required installation discourages widespread use and permanently disfigures the window or door track. Other devices have been provided which are intended to be temporarily applied to the window or track to secure the window against horizontal movement. However, such devices have typically not provided a sufficiently strong pressure against the track or window to prevent the sliding panel from being forced open.

Therefore, it is desirable to have a sliding glass window and door lock apparatus that does not require permanent installation and yet securely locks the sliding panel against vertical lifting and horizontal sliding.

SUMMARY OF THE INVENTION

An exemplary embodiment of the present invention includes a lock unit having dual eccentrics that are spring biased toward an opposing planar support flange. The lock unit is mounted so that a selected sidewall of a panel track is squeezed between the eccentrics and the support flange by the force of the spring. Slide stops extend from the support flange into the operative area of the track to prevent horizontal sliding movement of the panel.

The present invention also provides a lift stop which may be used in conjunction with the lock unit to prevent the sliding panel from being lifted clear of the lower track. It comprises a flat spring which has a bias toward assuming a U-shaped configuration. The spring legs are spread so that the lift stop may be inserted into the upper track above the panel. Spring action then causes the leg members to contact the sidewalls of the track and to frictionally hold the lift stop in position.

Thus the invention provides an apparatus that can be rapidly secured to the tracks of a sliding glass window and door without tools to secure the sliding panel thereof against unauthorized sliding movement. The spring bias provides a self-locking action. Any attempt to slide the sliding panel open with the lock unit mounted is firmly resisted by the frictional engagement between the track sidewall and the support flange on one side and the eccentrics on the other side. The engagement pressure between one eccentric and the track sidewall increases in response to an increase in the force utilized in an attempt to make the window open.

The lift stop is easily installed and removed without tools. It is effective in position to prevent unauthorized vertical movement of the sliding panel. An intruder cannot lift the sliding panel clear of the lower track, and furthermore vertical travel is limited to prevent any clearance between the sliding and fixed panels from being obtained. Therefore, no implement may be fitted between the panels to jimmy or operate the conventional lock of the sliding panel or the lock unit of the present invention from the outside.

It is therefore an object of the invention to provide a new and improved sliding glass window and door lock.

It is another object of the invention to provide a new and improved sliding glass window and door lock that prevents an intruder from lifting the sliding panel clear of the lower track.

It is another object of the invention to provide a new and improved sliding glass window and door lock that may be easily installed and removed without tools.

It is another object of the invention to provide a new and improved sliding glass window and door lock that is rapidly operated in the event of an emergency.

It is another object of the invention to provide a new and improved sliding glass window and door lock that resists attempts to force the sliding panel against the operation of the lock.

It is another object of the invention to provide a new and improved sliding glass window and door lock that is inexpensive to manufacture.

It is another object of the invention to provide a new and improved sliding glass window and door lock that has a long service life.

Other objects and many attendant advantages of the invention will become more apparent upon a reading of the following detailed description together with the drawings in which like reference numerals refer to like parts throughout and in which:

DESCRIPTION OF THE PREFERRED EMBODIMENTS

Figures 1, 2, 3, 4A, 4B, 5, 6, 7, 8, 9:
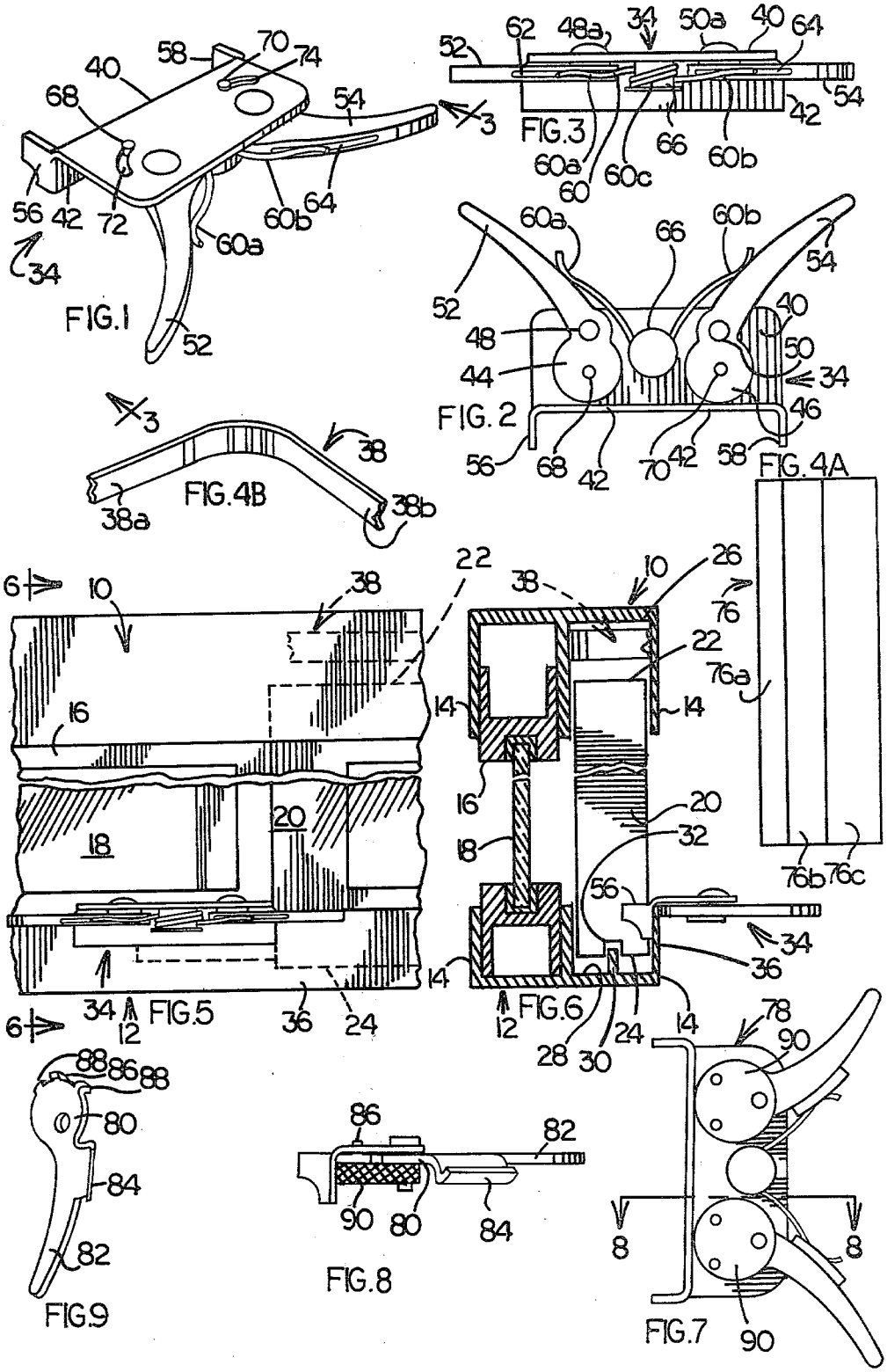
FIG. 1 is a perspective view of one embodiment of the lock unit.
FIG. 2 is a plan view of the underside of the lock unit shown in FIG. 1.
FIG. 3 is a front elevational view of the lock unit shown in FIG. 1, taken along line 3—3 of FIG. 1.
FIG. 4A is an elevational view of a metal blank from which a lift stop can be fabricated.
FIG. 4B is a perspective view of the lift stop formed from a portion of the blank shown in FIG. 4A.
FIG. 5 is a side elevational view of a sliding glass window and door assembly, with the lock unit of FIG. 1 and the lift stop of FIG. 4B installed.
FIG. 6 is a vertical section view taken along line 6—6 of FIG. 5.
FIG. 7 is a plan view of a second embodiment of the lock unit.
FIG. 8 is a sectional view of the lock unit of FIG. 7, taken along line 8—8 of FIG. 7.
FIG. 9 is a perspective view of a portion of the lock unit of FIG. 7.

By way of background, reference is first made to FIGS. 5 and 6 which illustrate the construction of a conventional sliding glass window and door assembly. The present invention is utilized with assemblies of this type. Typically they include a pair of vertical glass window sections. One of these sections is fixed and the other is supported for horizontal sliding movement in overlapping relationship with the fixed section. Specifically, as shown in FIGS. 5 and 6, a conventional sliding glass window and door assembly includes upper and lower channel beams 10 and 12. These beams are typically made of aluminum and each has three vertically extending flanges 14 thereof. A sliding panel 20, also comprising a rectangular frame surrounding and supporting a glass pane, is loosely mounted in the upper and lower channel beams between flanges 14 thereof which form upper and lower tracks. The panel 20 is adapted for horizontal sliding movement along the upper and lower tracks into and out of overlapping relationship with the fixed window frame 16 and glass pane 18 to open and close the door, respectively. The upper and lower surfaces 22 and 24 of the sliding panel are spaced from the upper and lower surfaces 26 and 28 respectively of the tracks formed by the channel beams. A rail 30 extends vertically from the lower surface 28 of the panel track and is received in a conformably shaped recess 32 formed in the lower surface 24 of the panel 20. The rail 30 serves to guide the panel 20 during its horizontal sliding movement in the upper and lower panel tracks.

FIG. 1 illustrates a preferred embodiment 34 of the lock unit of the present invention which is utilized to prevent horizontal sliding movement of the panel. As shown in FIGS. 5 and 6, the lock unit is mounted upon a sidewall such as 36 of one of the panel tracks. FIG. 4B illustrates a preferred embodiment 38 of the lift stop of the present invention which is utilized to prevent the sliding panel from being lifted clear of the lower track. As shown in FIGS. 5 and 6, the lift stop 38 is positioned between the upper surface 22 of the sliding panel and the surface 26 of the upper track formed by the channel beam 10. It will be understood from FIGS. 5 and 6 that the panel 20, in the absence of the lift stop 38 can be lifted so that its bottom edge will clear the sidewall 36 of the lower track and permit removal of the panel.

The structure and operation of the lock unit 34 will now be described in detail by way of reference to FIGS. 1 through 3. The unit includes a base in the form of a generally horizontally arranged planar member 40. A generally planar orthogonally related support flange 42 is connected along the one edge of the base. A pair of eccentrics 44 and 46 are mounted on the underside of the base 40 in side by side, spaced apart relationship. One side of the support flange 42 directly opposes each of the eccentrics. Means are provided for pivotally mounting the eccentrics on the base. A pair of pins 48 and 50 each extend vertically through the base and through one of the eccentrics. These pins may take the form of rivets having heads 48*a* and 50*a* (FIG. 3) whose shanks are free to rotate in suitably sized holes formed in the base 40 and which fit tightly within holes in the eccentrics.

A pair of operating levers 52 and 54 extend from the eccentrics 44 and 46, respectively. The operating levers are configured to curve away from one another to facilitate grasping thereof by the hand of a user as will be later described in greater detail. The eccentrics are shaped and pivotally mounted so that when their respective operating levers are spread apart the eccentrics move closer to the support flange 42. When the lock unit 34 is mounted on a track sidewall such as 36, the sidewall is engaged between the eccentrics and the support flange by the force of a spring hereafter described. The spring urges or biases the operating levers away from each other. A pair of slide stops 56 and 58 extend orthogonally from the support flange 42 away from the eccentrics. As show in FIGS. 5 and 6, the slide stops extend into the operative area of the lower panel track to prevent sliding horizontal movement of the panel. It will be understood that a single slide stop will also work and the position thereof may be changed along the length of the support flange.

Spring means are provided for biasing the eccentrics 44 and 46 (FIG. 2) toward the support flange 42. In the embodiment depicted in FIGS. 1 through 3, a torsion spring 60 is mounted between the eccentrics. The legs 60*a* and 60*b* of the spring have curved end portions which are received in corresponding grooves 62 and 64 formed along the inner edges of the operating levers 52 and 54 respectively. The intermediate portion 60*c* of the spring is coiled about a cylindrical spring fastener 66 secured to the base 40 between the eccentrics. The spring 60 is adapted for biasing the operating levers 52 and 54 to spread them apart and to urge the eccentrics toward the support flange 42. The spring may be formed in any suitable manner such as by bending an appropriate length of twenty gauge wire having the necessary resiliency.

The lock unit 34 is further provided with limiting means for preventing further pivotal movement of the operating levers toward each other at a point when they are generally parallel. Such an arrangement facilitates the manual installation of the locking unit on the track sidewall. In the uninstalled locking unit, the spring 60 will spread the operating levers apart until the eccentrics are abutted against the opposing face of the support flange 42. In order to install the locking unit on the track sidewall 36, the eccentrics must be moved away from the support flange to provide the necessary clearance so that the sidewall can be received between the support flange and the eccentrics. This is accomplished by grasping the operating levers between the thumb and index finger of the hand and squeezing the operating levers together. Without a suitable stop mechanism for limiting the pivoting motion of the eccentrics and the operating levers during the squeezing operation, the unit would have a tendency to flop in the hand. It would also be difficult to achieve the desired generally perpendicular alignment between the lock unit and the track sidewall necessary to fit the sidewall between the eccentrics and the support flange. By limiting the pivoting movement of the operating levers to prevent further squeezing together thereof when they are approximately parallel, i.e. when lines tangent to the portions of their inner edges closest to the eccentrics are roughly parallel, this objective may be accomplished. That is to say both levers may be squeezed inwardly until they stop. Thereafter, the maintenance of a firm squeezing pressure on the lever will permit the support flange to be brought into overlapping relationship with the track sidewall so that it fits between the support flange and the eccentrics.

To limit the movement of the levers, a pair of limit pins 68 and 70 may be rigidly secured through the center of the eccentrics 44 and 46 as shown in FIG. 2. The limit pins are received in corresponding arcuate apertures 72 and 74 cut through the base 40. These apertures preferably extend far enough so that the eccentrics can be pivoted into engagement with the support flange 42 and so that the operating levers can be swung toward each other approximately the same distance.

The lift stop 38, shown in FIG. 4B, is a separate element in the form of a generally flat spring formed of spring steel which is biased toward assuming a U-shaped configuration. The legs 38*a* and 38*b* of the spring preferably have serrated engagement edges. When the apparatus of the present invention is sold as a kit, the lock unit may be preassembled or unassembled. The kit may also contain a blank 76 of suitable spring steel having linearly arranged perforations. The perforations allow strips of various widths such as 76*a*, 76*b* and 76*c* to be broken therefrom and bent to form the lift stops such as that shown in FIG. 4B. The required width for the lift stop will depend upon the amount of clearance between the upper surface 22 of the sliding door 20 and the surface 26 of the upper track (see FIG. 6).

FIGS. 7 through 9 relate to a second embodiment 78 of the lock unit which is generally similar in all respects to the lock unit 34 depicted in FIGS. 1 through 3, except for differences in its eccentrics and operating levers. The lock unit 78 includes a pair of eccentrics such as 80 (FIG. 9). The eccentric 80 has a suitably curved operating lever 82 formed integrally therewith. Each operating lever is formed with a hook-like receptacle 84 along an inner edge thereof for receiving a leg of the torsion spring. The eccentric 80 is formed with a single upturned guide flange 86 which fits within a corresponding arcuate aperture in the base to limit the pivoting movement of the eccentric. The eccentric 80 is also formed with a pair of adjacent, downwardly turned connection flanges 88.

Each eccentric of the lock unit 78 further includes a circular cam member such as 90 (FIG. 8), having a pair of spaced apart holes therethrough. These holes tightly receive the connection flanges 88 therein to securely attach the member to an eccentric such as 80. Pivot pins extend through cam members, offset from their centers, and through the eccentrics and the base. The cam member 90 preferably has a serrated engagement surface which may be provided by knurling the outer circumference thereof as shown in FIG. 8. Preferably the cam members are made of a material, such as hardened steel, which is harder than the aluminum panel tracks.

The installation of the lock unit 34 and lift stop 38 of FIGS. 1 and 4B respectively, will now be described by way of reference to FIGS. 5 and 6. Initially the sliding panel 20 is slid to its extreme open position. In this position, the sliding panel exposes the upper track so that the flat lift stop 38 may be installed. For installation, the U-shaped spring forming the lift stop 38 is grasped by its legs 38*a* and 38*b* and biased toward a relatively flat configuration. The spring is then inserted into the upper track adjacent to surface 26 of the channel beam 10 and released. Upon release, the internal bias of the spring causes its legs to move back toward a U-shaped configuration, increasing the widthwise dimension of the spring. This causes the base or intermediate portion of the spring to contact the middle flange 14 of the channel beam 10, forming one sidewall of the upper track. The serrated ends of the spring 38 contact the outer flange 14 forming the other sidewall of the upper track. Thus the lift stop 38 is firmly held in position as indicated in FIGS. 4 and 5.

Thereafter, when the sliding panel 20 is returned to its closed position, the lift stop 38 will be interposed between the upper surface 22 of the sliding panel and the surface 26 of the upper track. Accordingly, any attempt to lift the panel 20 will cause contact between the panel 20 and the lift stop 38, sharply limiting the upper travel of the panel. Therefore, the panel 20 cannot be moved vertically a sufficient distance for it to clear the lower track. Nor can it be moved vertically a sufficient distance for an implement to be placed between the panel and the sidewall 36 of the lower track.

The lock unit 34 is installed on the sidewall 36 of the lower track in the following manner. The user grasps the operating levers 52 and 54 and squeezes them together to move them to their intermost positions, i.e. when they are as close together as they will go. Next the sidewall 36 is interposed between the support flange 42 and the eccentrics 44 and 46 as shown in FIGS. 5 and 6. Thereafter the user releases the operating levers and the torsion spring 60 spreads the levers apart and rotates the eccentrics into engagement with the sidewall 36 of the lower track. Thus the track sidewall is squeezed between the supporting flange and the eccentrics by the force of the spring. Any attempt to slide the sliding panel 20 will cause the end of the panel to contact the slide stop 58. Since the eccentrics are held under constant pressure against the fixed sidewall 36, the frictional engagement between the support flange 42 and the sidewall and between the support flange and the eccentrics will prevent the lock unit from being moved horizontally by the sliding panel 20. Any relative movement caused by force applied to the slide stop 58 will cause an increase in the pressure exerted by the eccentric 44 against the sidewall 36. Thus, a greater intruder applied force results in greater locking force.

From the inside, the lock unit 34 is quickly removed by squeezing the operating levers together, thereby providing sufficient clearance between the eccentrics and sidewalls 36 such that the entire device may be slid clear or lifted from the sidewall 36. The panel 20 may be removed from the sliding glass window and door assembly for cleaning or other service by sliding the panel beyond the point of installation of the lift stop 38.

The second embodiment 78 of the lock unit shown in FIGS. 7, 8 and 9 is installed using the same procedure as described above with regard to the lock unit 34.

Having described the preferred embodiments, it will be apparent that the present invention permits a modification in both arrangement and detail. I claim as my invention all such modifications as come within the true spirit and scope of the following claims.

I claim:

1. A removable lock unit for securely locking a sliding panel against horizontal sliding movement along upper and lower parallel tracks having at least one sidewall, comprising:

a planar base;

a planar support flange secured along one edge of the base orthogonal to the base;

a pair of planar rounded eccentrics each having an engagement surface along an edge thereof, each eccentric including a circular cam member having a serrated engagement surface and a pair of holes for tightly receiving a pair of connection flanges extending from a flat circular element;

a pair of curved operating levers each integrally formed with and extending from one of the circular elements;

means for pivotally mounting the eccentrics on the base in side by side relationship so that the levers curve away from each other and so that spreading the levers apart moves the engagement surfaces of the eccentrics into contact with the one side of the support flange;

spring means for biasing the engagement surfaces of the eccentrics toward the one side of the support flange, including a single tension spring having a pair of legs, each of the legs contacting and pushing against an inner edge of one of the levers to spread them apart so that the track sidewall can be squeezed between the support flange and the engagement surfaces of the eccentrics by the force of the spring;

means for limiting the pivotal movement of the levers so that the levers can each be swung toward each other through a predetermined equal distance to facilitate grasping of the levers between the thumb and index finger of a user and thereby ease installation of the unit on the track sidewall;

a slide stop connected to and extending substantially orthogonally from the other side of the support flange;

whereby the unit can be securely mounted with the track sidewall frictionally engaged between the engagement surfaces of the eccentrics and the support flange so that the slide stop extends into the operative area of the track to prevent sliding movement of the panel.

* * * * *